United States Patent [19]

Plohberger et al.

[11] Patent Number: 5,058,614

[45] Date of Patent: Oct. 22, 1991

[54] DEVICE FOR CONTROLLING THE LIFT OF A HYDRAULICALLY OPERATED VALVE

[75] Inventors: Diethard Plohberger; Volker Pichl, both of Graz; Herwig Ofner, Stübing, all of Austria

[73] Assignee: Avl Gesellschaft Für Verbrennungskraftmaschinen Und Messtechnik M.B.H. Prof. Dr. Dr. h.c. Hans List, Graz, Austria

[21] Appl. No.: 525,712

[22] Filed: May 21, 1990

[30] Foreign Application Priority Data

May 24, 1989 [AT] Austria ..... A1267/89

[51] Int. Cl.[5] ..... F16K 31/12

[52] U.S. Cl. ..... 137/1; 60/583; 60/584; 239/96; 239/124; 251/57

[58] Field of Search ..... 60/583, 584; 123/446, 123/447, 501; 137/1; 251/57; 239/91, 96, 124, 533.4, 533.5, 533.7, 533.8

[56] References Cited

FOREIGN PATENT DOCUMENTS 0204687 5/1986 European Pat. Off. .

*Primary Examiner*—Gerald A. Michalsky

*Attorney, Agent, or Firm*—Watson, Cole, Grindle & Watson

[57] ABSTRACT

In a device for controlling the lift of a hydraulically operated valve comprising an actuating element which is pressure-loaded or spring-loaded in closing direction and which acts as the boundary of an actuating chamber in the valve cage, and further comprising a pressure-generating unit, the valve lift is made continuously adjustable, independent of the control times of the valve, by providing that a flying setting plunger be used, which is guided in a cylinder, and which bounds a pressure from the actuating chamber in the valve cage, and by further providing that the pressure-generating unit have a high pressure line controlled by a valve and leading into the pressure chamber, as well as a low pressure line controlled by another valve and leading into the actuating chamber, the setting plunger being pressed against a stop in the cylinder during maximum valve lift.

8 Claims, 4 Drawing Sheets

DEVICE FOR CONTROLLING THE LIFT OF A HYDRAULICALLY OPERATED VALVE

BACKGROUND OF THE INVENTION

This invention relates to a method and device for controlling the lift of a hydraulically operated valve comprising an actuating element bounding an actuating chamber in the valve cage, which element is pressure-loaded or spring-loaded in closing direction, and further comprising a pressure-generating unit.

DESCRIPTION OF THE PRIOR ART

A device of this type has been published in EP-A 328602, for example, where a gas exchange chamber is controlled by a valve element of an injection valve opening in outward direction into the cylinder of an internal combustion engine. In this variant compressed gases are taken from the cylinder during one working cycle, and are stored temporarily, and are then injected into the cylinder of the internal combustion engine during the subsequent working cycle, together with the fuel fed into the gas exchange chamber on the side of the valve.

As regards adjustment of control times of the injection device to various engine parameters such as load or speed, variants permitting control of the lifting rate of the valve needle or a change of the needle lift are described in EP-A 328602. The advantages over versions without variable needle lift become apparent when the engine is operated at low load or at full load, above all, the positive influence on the emission behavior of the engine.

In the known variant of valve lift control, the valve needle is actuated by a plunger, which is provided with a step forming an annular chamber together with the valve cage. This annular chamber is subject to system pressure from a metering device via a check valve. As soon as the plunger of the injection valve moves downwards and opens the valve, the annular chamber is reduced in size, and the fuel is displaced and injected into the gas exchange chamber on the side of the valve via a check valve. The valve element of the injection valve will open only to the extent corresponding to the injection volume delivered by the metering unit, which will obtain a degree of valve lift increasing with an increase in engine load. With this type of simultaneous control the needle lift of the injection valve is proportional to the amount of fuel injected.

For optimum adjustment of the control times of fuel or fuel/air injection valves to the state of load and/or speed of an internal combustion engine, however, lift, opening time and closing time of the valve should be made individually adjustable, i.e., independent of the injected volume, which cannot be achieved by means of the known devices and techniques.

SUMMARY OF THE INVENTION

It is an object of the invention to propose a method and a device permitting a continuously variable lift of a hydraulically actuated valve for each individual working cycle, independent of the control times of the valve, in which manufacturing tolerances and temperature-related changes of the length of the valve or valve cage do not affect the valve lift.

In the invention this object is achieved by providing a flying setting plunger guided in a cylinder, which bounds a pressure chamber in the cylinder and separates the pressure chamber from the actuating chamber in the valve cage, and by providing that the pressure-generating unit have a high-pressure line controlled by a valve and leading into the pressure chamber, as well as a low-pressure line controlled by another valve and leading into the actuating chamber, the setting plunger being pressed against a stop in the cylinder at maximum lift of the valve.

In this context it is provided by the invention that an actuating chamber, which is situated between an actuating element of the valve and a flying setting plunger, be subjected to low pressure in the closed position of the valve, such that the setting plunger is lifted from a stop, until a valve controlling the low pressure is closed, which will define a given lift, and that the setting plunger be subjected to high pressure via the control of a valve, such that the setting plunger is moved until it reaches its stop and the valve is forced open by the incompressible medium in the actuating chamber, and further, that the low pressure control valve be opened, such that the actuating chamber is emptied and the valve is closed by the closing force acting on the actuating element. Via the valves in the high pressure line and in the low pressure line it will be possible to continuously adjust the opening and closing times of the valve and, independently, the valve lift. The valve may be actuated by a plunger guided in a cylinder, or by a diaphragm that is pressure-loaded or spring-loaded in the closing direction of the valve. By means of the stop in the cylinder, against which the setting plunger is pressed at the beginning of each individual working cycle, the initial position of the flying setting plunger is newly defined for each cycle, which will compensate manufacturing tolerances and temperature-related changes in length.

It is provided in a further development of the invention that the valve cage and the cylinder containing the setting plunger be integrated in one piece, such that the axes of the valve and of the setting plunger coincide. Other variants are possible, provided that the setting plunger is placed between actuating chamber and pressure chamber, and the volume of the actuating chamber can be varied by means of the setting plunger.

The low pressure part of the device permits several design variants, a major feature being the use of a solenoid-controlled two-way valve which is located in the low pressure line connected to the pressure-generating unit via a reducing valve, and a return line with a pressure-maintaining element being included between the reducing valve and the two-way valve. Via the return line between the reducing valve and the two-way valve the excess fuel remaining at the end of an opening/closing cycle of the valve can be returned from the actuating chamber to the fuel tank.

According to the invention the pressure-maintaining element could also be configured as a pressure tank with an air cushion. In all variants the pressure difference between low-pressure part and high-pressure part of the pressure-generating element need only be large enough to overcome the closing force of the valve.

The invention further provides that a solenoid-controlled three-way valve be located in the high-pressure line, one of whose outlets is connected to the pressure chamber while the other one leads to a return line containing a throttle. By means of this valve the pressure chamber is subjected to high pressure, such that the valve is forced open by the incompressible medium between flying plunger and actuating element of the valve, or rather, the pressure chamber is relieved by discharging into a fuel tank.

A preferred application of the invention is concerned with the control of a fuel/gas injection valve of an internal combustion engine, in which the valve, which opens outwardly, controls a gas exchange chamber located in the valve cage, which chamber is connected to the pressure-generating unit via a metering device. In this way the amount of fuel injected into the gas exchange chamber can be metered completely independently of the valve control.

In another preferred application of the invention concerned with a fuel injection valve of an internal combustion engine the valve opens inwardly and controls a fuel chamber located in the valve cage, which chamber is connected to the pressure-generating unit via a pressure line.

BRIEF DESCRIPTION OF THE DRAWINGS

The invention will be further described by way of example only with reference to the accompanying drawings, in which.

DETAILED DESCRIPTION OF PREFERRED EMBODIMENTS

Figure 1:
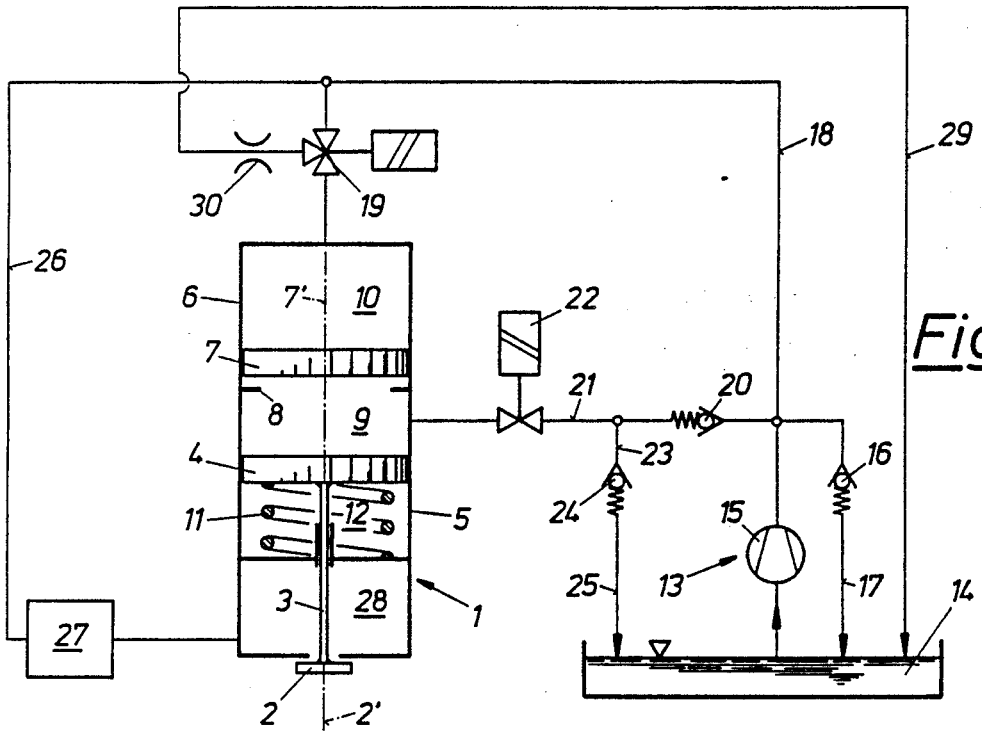
FIG. 1 is a schematic view of a device for control of the lift of a hydraulically operated valve, in particular a fuel/gas injection valve of an internal combustion engine.
Figure 1A:
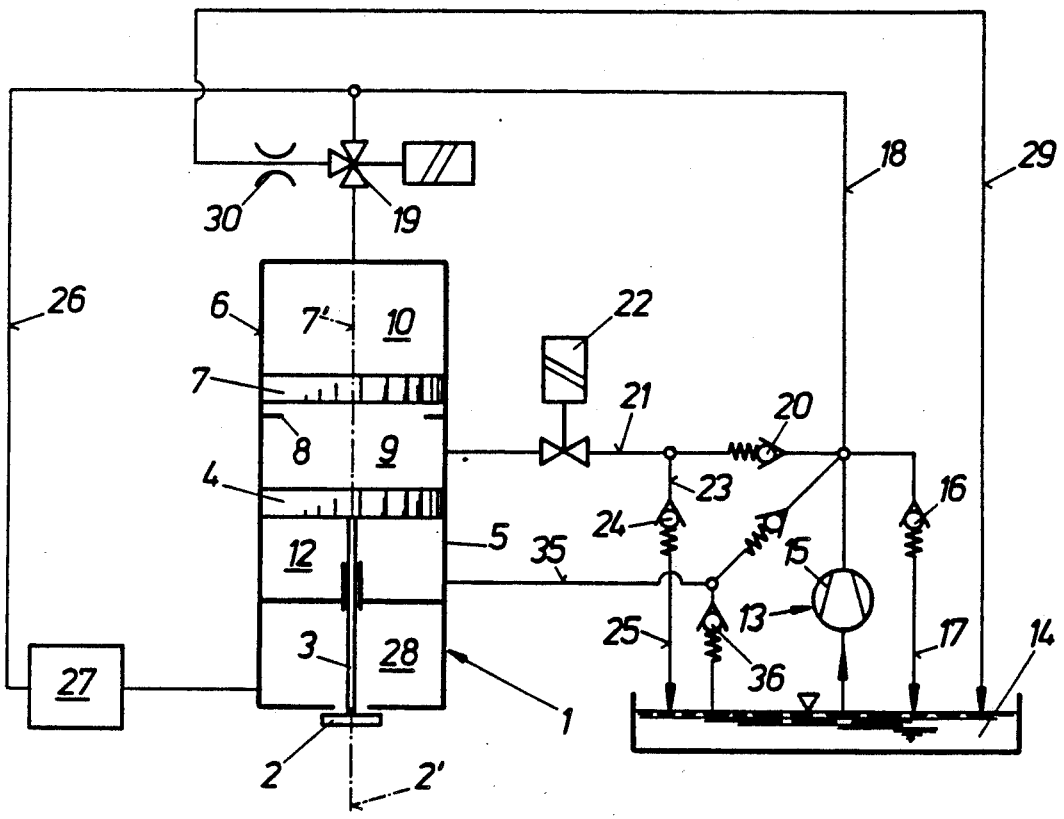
FIG. 1*a* depicts a variant of the device shown in FIG. 1.

The device for control of the lift of a valve presented in FIG. 1 has a fuel/gas injection valve 1, whose valve element 2, which opens in an outward direction, is actuated via a stem 3 by means of an actuating element or plunger 4 that is spring-loaded in a closing direction. A cylinder 6 is cast integral with the valve cage 5, containing a flying setting plunger 7. The setting plunger 7, which is freely movable in an axial direction until a stop 8 is reached, separates an actuating chamber 9 in the valve cage 5, which is bounded by the plunger 4, from the pressure chamber 10 in the cylinder 6. The valve axis 2' and the axis 7' of the setting plunger 7 coincide in this variant. The valve 2 is closed by a spring 11. It would also be possible, however, to pressurize the chamber 12 containing the spring 11. For this purpose, as shown in FIG. 1*a*, the chamber 12 can be connected to the pressure-generating unit 13 by a pressure line 35, with a valve 36 used to control the pressure in the chamber 12.

The pressure-generating unit 13 of the device is provided with a high-pressure pump 15 connected to a fuel tank 14, whose pressure is adjusted via a throttle valve 16. Excess fuel is delivered to the fuel tank 14 via a return line 17. The pressure-generating unit 13 has a high-pressure line 18 supplying the pressure chamber 10 in the cylinder 5 via a solenoid-controlled three-way valve 19. In one switching position of the three-way valve 19 the pressure chamber 10 may be relieved by discharging into the fuel tank 14 via a return line 29 and a throttle 30. In addition, a low-pressure line 21 is supplied by the pressure-generating unit via a one-way reducing valve 20, which line 21 is connected to the actuating chamber 9 via a solenoid-controlled two-way valve 22. Between the reducing valve 20 and the two-way valve 22 is placed a return line 23 including a pressure-maintaining element, the latter being configured as a pressure-keeping valve 24 with a connecting line 25 towards the fuel tank 14 in this variant.

A branch-off 26 from the pressure line 18 leads to a metering device 27 determining the amount of fuel to be delivered to the gas exchange chamber 28 located in the valve cage 5.

Figure 4:
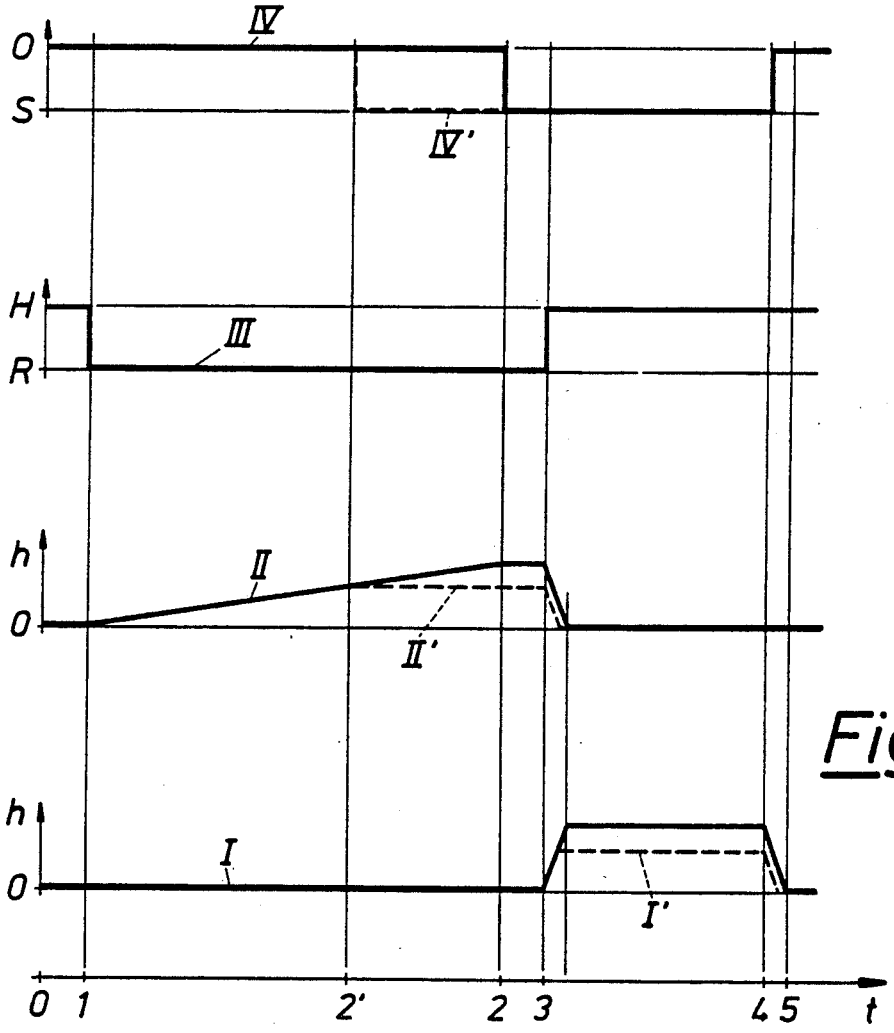
FIG. 4 shows a control diagram of a valve as described by the invention.

Following is a more detailed explanation of the operating mode of the device as based on FIGS. 1 and 4. In the control diagram of FIG. 4 the points in time under observation, i.e., 0 to 5, are plotted on the abscissa. Curve I represents the lift of the injection valve, curve II the lift of the setting plunger 7 from stop 8; curve III the switching positions of the three-way valve 19, with the pressure chamber being subject to high pressure in position H and relieved in position R. Curve IV represents the switching positions of the two-way valve 22, O meaning open and S shut.

Time 0: Before the beginning of the lifting cycle the two-way valve 22 and the three-way valve 19 are switched such that the high pressure (20–100 bar) generated by the pump 15 still is acting on the pressure chamber 10 and on the flying setting plunger 7, which is thus pressed against its stop 8. The injection valve 2 is already closed by the force of the spring 11.

Time 1: At time 1 the three-way valve 19 is switched such that the connection between pressure chamber 10 and pump 15 is severed and the return line 29 into the fuel tank 14 is opened by the throttle 30 for the fuel remaining in the pressure chamber 10. This causes a pressure drop in pressure chamber 10, thus activating the pressure (2–10 bar) acting upon the lower side of the flying setting plunger 7 in the actuating chamber 9, and causing the plunger 7 to lift from the stop 8 and move upwards.

In the variant of FIG. 1 the amount of fuel required for this purpose is admitted via the one-way reducing valve, the high pressure generated by the pump 15 being reduced to the low pressure mentioned above. It should be noted in this context that the pressure-keeping valve 24 in the return line 23 must be adjusted in such a way as to prevent it from opening while the low pressure is being applied.

Time 2: At time 2 the two-way valve 22 is being shut, thus ending the lifting motion of the setting plunger 7. The period between time 1 and time 2 determines the fuel volume accumulating in the actuating chamber 9, and thus the extent of the lift performed by the setting plunger 7, and, finally, the stroke of the valve element 2 in the injection valve 1.

Time 3: At time 3 the return line 29 is shut by the three-way valve 19 and the pressure chamber 10 is connected to the high-pressure line 18. Thus the upper side of the setting plunger 7 is subjected to high pressure. As the two-way valve 22 is shut, the amount of fuel contained in the actuating chamber 7 remains constant, effecting a quasi-rigid connection between setting plunger 7 and plunger 4 on account of its incompressibility. Due to the prevailing high pressure the force of the spring 11 is overcome and the valve element 2 of the injection valve 1, which is connected with the plunger 4 via the stem 3, is opened. This process will end when the setting plunger 7 has reached its stop 8. At this point of the cycle the valve element 2 has reached its maximum lift and will remain in this position until time 4. The period between time 3 and time 4 thus represents the duration of injection and recharging of the injection valve 1.

Time 4: At time 4 the two-way valve 22 opens. As a consequence the fuel contained in the actuating chamber 9 can be drained via the pressure-keeping valve 24. Whereas the setting plunger 7 subject to high pressure retains its position, the plunger 4 is pushed upwards by the spring 11 and the injection valve 1 is closed. In the variant according to FIG. 1 the pressure-keeping valve 24 is opened by the fuel pressure generated by the valve spring in the low pressure line 21, and the fuel displaced by the plunger 4 flows back into the fuel tank 14.

Time 5: After the valve element 2 has closed a cycle is completed and the initial state (time 0) is restored. The subsequent cycle may start.

Curves I', II', IV' indicated by broken lines in the diagram of FIG. 4 represent the operating sequence with an earlier closing time of the two-way valve 22 (time 2') and thus a smaller lift of the valve element 2 and the setting plunger 7.

Figure 2:
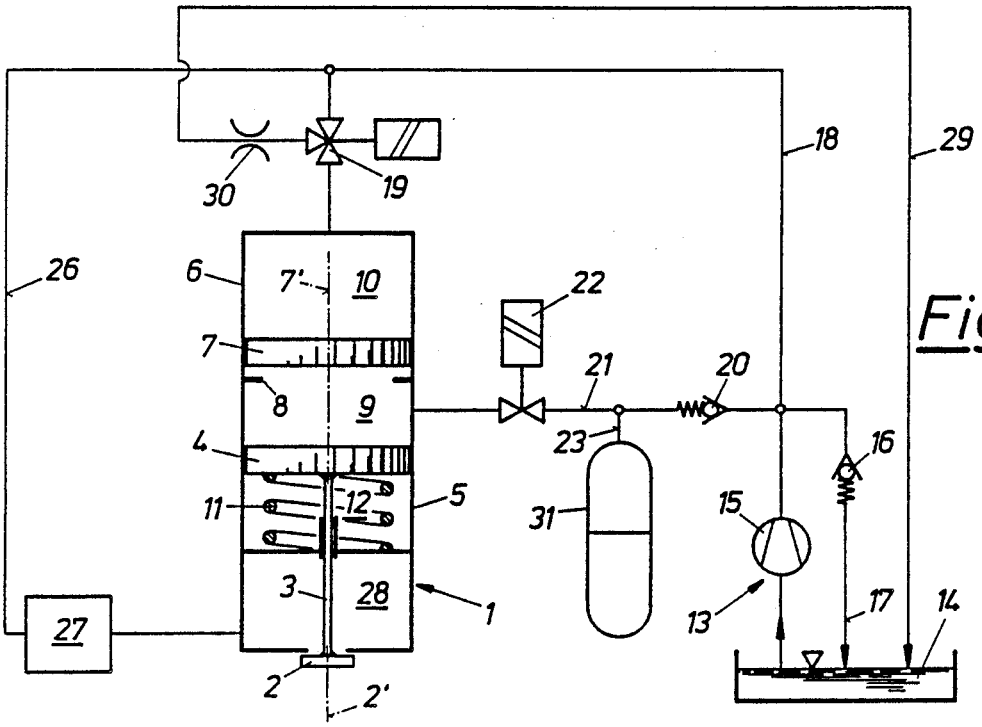
FIG. 2 depicts another variant of the device shown in FIG. 1.

The variant shown in FIG. 2 differs from that in FIG. 1 only by the pressure-maintaining device, which is configured as a pressure tank 31 with an air cushion in this variant. At time 1 this pressure tank 31 delivers the amount of fuel necessary for lifting the setting plunger 7. The pressure-reducing valve 20 opens only if the fuel volume in the pressure tank 31—and thus the pressure in the low pressure part—should drop below a given minimum as a consequence of leakages in the low pressure part.

In the variant of FIG. 2 the spring 11 overcomes the counter-pressure of the pressure tank 31 at time 4, whereupon the displaced fuel volume collects in this tank.

Figure 3:
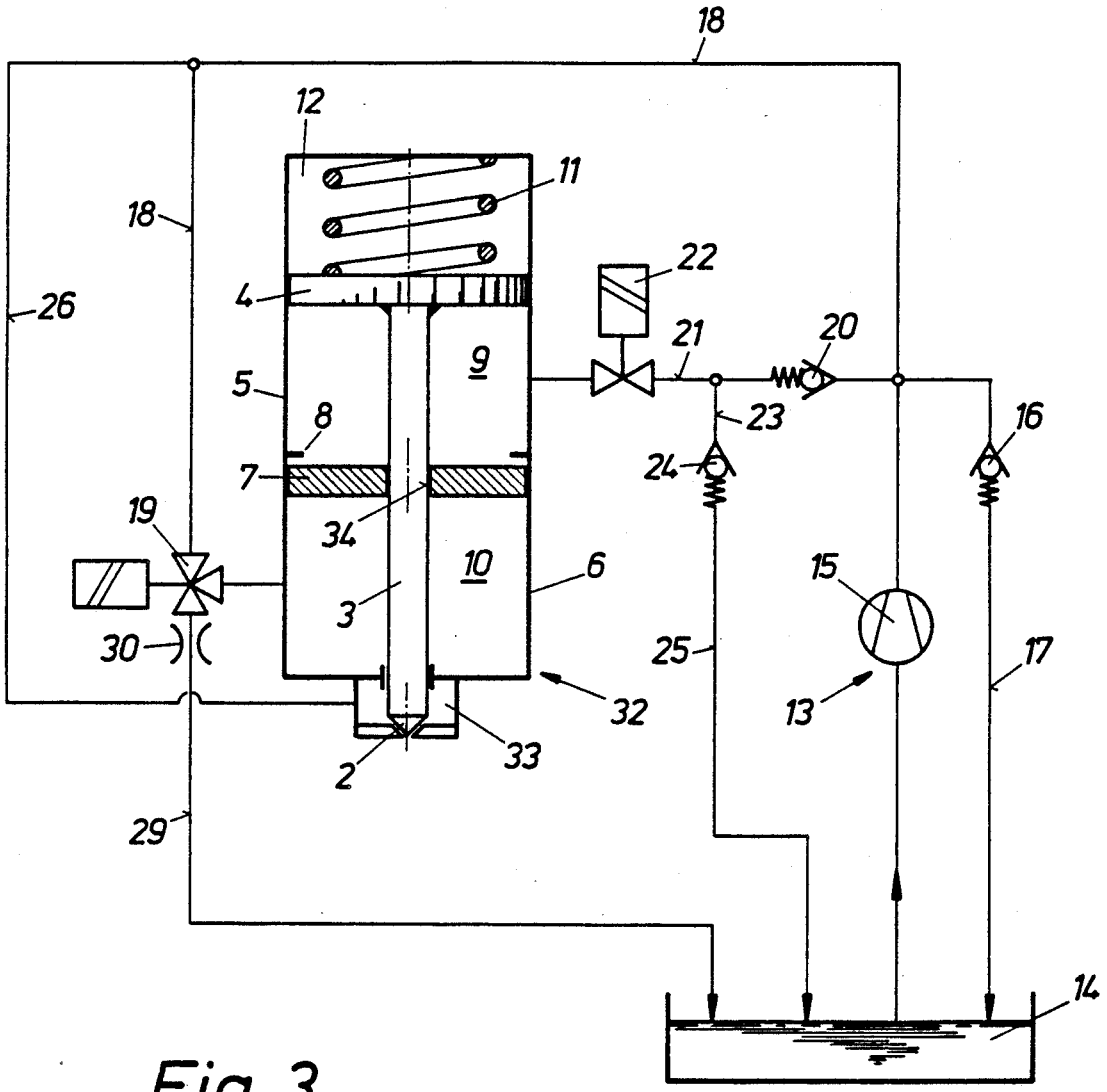
FIG. 3 shows a variant concerned with the control of a fuel injection valve of an internal combustion engine.

In the variant given in FIG. 3 the device for control of the valve lift is employed in a fuel injection valve 32. Elements corresponding to those in the descriptions of FIGS. 1 and 2 have the same reference numbers here. In this instance a valve element 2 is provided which opens inwardly and which controls a fuel chamber 33 located in the valve cage 5. A connection with the pressure-generating unit 13 is established via line 26. In this variant the pressure chamber 10 is placed between the actuating chamber 9 and the fuel chamber 33, and the setting plunger 7, which can be moved as far as to the stop 8, must be provided with a bore 34 for the stem 3 of the valve element 2.

Figure 3A:
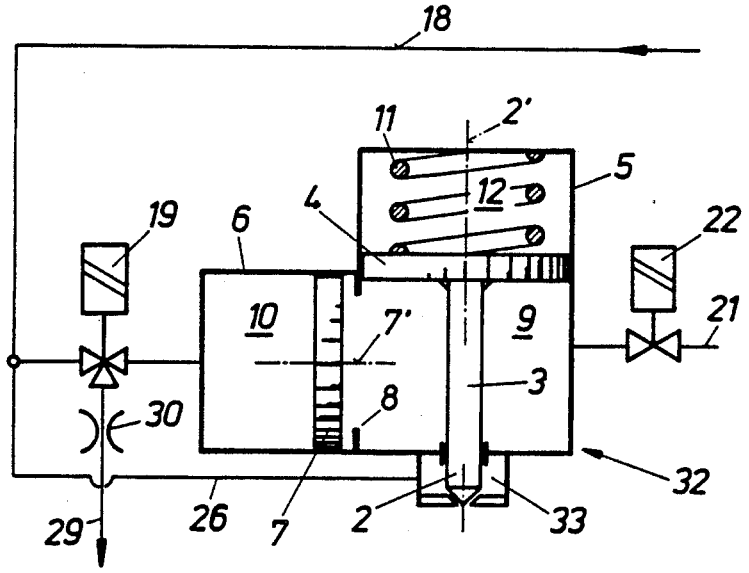
FIG. 3*a* shows a variant of the device shown in FIG. 3.

Another possible variant is shown in FIG. 3*a*, in which the cylinder 6, together with the setting plunger 7, is placed at the side of the valve cage 5, such that bore 34 is not needed. The axis 7' of the setting plunger and the valve axis 2' are normal relative to each other. The wall of the valve cage 5 may serve as a stop 8 for the setting plunger 7.

In an injection valve of this type the amount of fuel to be injected should be determined via the opening time and the lift of the valve element. For lesser injection volumes a smaller lift will help obtain better atomization, longer injection times enhancing fuel processing.

We claim:

1. A device for controlling the lift of a hydraulically operated valve comprising an actuating element situated in a cylinder, bounding an actuating chamber in said cylinder, which actuating element is biased in a closing direction, and comprising a flying setting plunger guided in said cylinder, which bounds a pressure chamber in said cylinder and separates said pressure chamber from said actuating chamber, and further comprising a pressure-generating unit having a high-pressure line controlled by a first valve and leading into said pressure chamber, as well as a low-pressure line controlled by a second valve and leading into said actuating chamber, and wherein said setting plunger is pressed against a stop in said cylinder at maximum lift of said hydraulically operated valve.

2. A device according to claim 1, wherein said second valve is a solenoid-controlled two-way valve, and wherein said low pressure line is connected to said pressure-generating unit via a reducing valve, and a return line with a pressure-maintaining element is included between said reducing valve and said solenoid-controlled two-way valve.

3. A device according to claim 2, wherein said pressure-maintaining element is configured as a pressure-tank with an air cushion.

4. A device according to claim 1, wherein said first valve is a solenoid-controlled three-way valve comprising a first and a second outlet, wherein said first outlet is connected to said pressure chamber and said second outlet leads to a return line containing a throttle.

5. A device for controlling the lift of a hydraulically operated valve comprising an actuating element situated in a first cylinder, bounding an actuating chamber in said first cylinder, which actuating element is biased in a closing direction, and comprising a flying setting plunger guided in a second cylinder, which bounds a pressure chamber in said second cylinder and separates said pressure chamber from said actuating chamber, and further comprising a pressure-generating unit having a high-pressure line controlled by a first valve and leading into said pressure chamber, as well as a low-pressure controlled by a second valve and leading into said actuating chamber, and wherein said setting plunger is pressed against a stop in said cylinder at maximum lift of said hydraulically operated valve.

6. A device according to any of claims 1 to 5, for control of a hydraulically operated, outwardly opening injection valve for fuel and gas of an internal combustion engine, wherein said injection valve controls a gas exchange chamber located in the valve housing, and wherein said exchange chamber is connected to said pressure-generating unit via a metering device.

7. A device according to any of claims 1 to 5, for control of a hydraulically operated, inwardly opening fuel injection valve of an internal combustion engine, wherein said injection valve, controls a fuel chamber located in the valve housing, and wherein said fuel chamber is connected to said pressure-generating unit via a pressure line.

8. A method for controlling the lift of a hydraulically operated valve comprising an actuating element which is biased in a closing direction, wherein an actuating chamber, which is situated between said actuating element of said hydraulically operated valve and a flying setting plunger, is subjected to low pressure in the closed position of said valve, such that the setting plunger is lifted from a stop, until a valve controlling the low pressure is closed, which will define a given lift, of said hydraulically operated valve and wherein said setting plunger is subjected to high pressure via the control of another valve, such that said setting plunger is moved until it reaches said stop and said hydraulically operated valve is forced open by an incompressible pressure medium in said actuating chamber, and finally, wherein said low pressure control valve is opened, such that said actuating chamber is emptied and said hydraulically operated valve is closed by said actuating element.

* * * * *